US006080975A

United States Patent [19]

Kuse et al.

[11] Patent Number: 6,080,975

[45] Date of Patent: Jun. 27, 2000

[54] KITCHEN WORKPLATE WITH INTEGRATED COOKING FIELD

[76] Inventors: Kolja Kuse, Oberföhringerstrasse 175 RG, 81925 Munich; Eduard Schramm, Hofmarkstrasse 25, 94136 Thyrnau; Paul Grohs, Vorm Haus 8, 94107 Untergriesbach, all of Germany

[21] Appl. No.: 08/596,335

[22] PCT Filed: May 16, 1995

[86] PCT No.: PCT/EP95/01858

§ 371 Date: Aug. 5, 1996

§ 102(e) Date: Aug. 5, 1996

[87] PCT Pub. No.: WO95/33359

PCT Pub. Date: Dec. 7, 1995

[30] Foreign Application Priority Data

May 24, 1994 [EP] European Pat. Off. ..... 94107945

[51] Int. Cl.[7] ..... H05B 6/12

[52] U.S. Cl. ..... 219/622; 219/218; 219/624

[58] Field of Search ..... 219/622, 624, 219/623, 627, 677, 662, 632, 218, 236

[56] References Cited

U.S. PATENT DOCUMENTS

| | | | |
|---|---|---|---|
| 3,740,513 | 6/1973 | Peters, Jr. et al. | 219/622 |
| 4,206,336 | 6/1980 | Cunningham | 219/622 |
| 4,446,350 | 5/1984 | Mizukawa et al. | 219/622 |
| 4,453,068 | 6/1984 | Tucker et al. | 219/625 |
| 4,833,288 | 5/1989 | Poumey | 219/622 |
| 4,910,372 | 3/1990 | Vukich | 219/622 |
| 5,313,049 | 5/1994 | Strat et al. | 219/444 |
| 5,428,207 | 6/1995 | Essig et al. | 219/622 |

*Primary Examiner*—Teresa Walberg
*Assistant Examiner*—Jeffrey Pwu
*Attorney, Agent, or Firm*—Horst M. Kasper

[57] ABSTRACT

A kitchen workplate with an integrated cooking has a stone workplate (1) and a cavity structure (0) milled out at a predetermined position in an underside of the stone workplate (1) in which an induction coil (3) is placed. The cavity structure (0) and the induction coil form a cooking field. A reinforcement (6) provides a mechanical stabilization in the region of the cooking field in order to prevent crack formation in the stone workplate (1) resulting from thermal effects. A plurality of metallic distance (7) spacers are disposed on the surface of the stone workplate (1) and mark a place for placing cooking utensils into the cooking field and provide a thermal insulation employing air as a medium of insulation.

27 Claims, 2 Drawing Sheets

KITCHEN WORKPLATE WITH INTEGRATED COOKING FIELD

CROSS-REFERENCE TO RELATED APPLICATIONS

This application is a PCT-Application filed May 16, 1995 and bearing No. PCT/EP/01858.

BACKGROUND OF THE INVENTION

1. Field of the Invention

The invention relates to the area of kitchen technology. In particular, the invention refers to the construction of a kitchen workplate as a cooking field, which combines the functions of a cooking stove and of a workplate in a novel fashion.

2. Brief Description of the Background of the Invention Including Prior Art

For a long time the open flame has been the most important source for the feeding of heat required during cooking.

The reason for this, with the exception of grilling (radiation heat), is associated less with the flame itself, but is connected with the purely technical fact that a change of the feeding of heat can be induced very quickly. Here, the most important reason is to be found why the top gastronomical chefs still cook with gas. For example, if one switches the gas flame off during cooking, then the feeding of heat is instantly interrupted. This is not possible in connection with a conventional electric plate cooking field or with a conventional glass ceramic cook field based on the after-heating effect of the heated electric spirals. The automatic control of the feeding of heat with gas occurs substantially more spontaneous. A quick regulation and automatic control of the fed heat, however, is of a decisive interest in connection with the use of temperature-sensitive ingredients, which obtain the desired consistency only in case of a well-metered heat treatment, such as for example in the preparation of sauces with a high fat content.

Despite the indispensability in connection with cooking, gas stoves are associated with the disadvantage that a substantially mechanical expenditure has to be provided for the generation of the flame on the cooking field in order to be able to furnish an accident-proof gas flame.

Organic materials, such as splashes of fat and food residues, deposit on these mechanical parts during cooking operations, which are then burnt into the gas burners on the cooking field by the flame. Overall, the gas cooking field (burner, recess) and the grate required for positioning the pots on the flame are cleaned only with difficulty and are accompanied by substantial time expenditures.

The sticking of burnt-on food residues and fats occurs also in connection with the electric stove, as well as in case of glass-ceramic cooking fields, which react with sensitivity to the burnt-on organic materials upon a long-term use and which are therefore more and more difficult to clean with increasing age based on the damaging of the surface. Glass-ceramic cooking fields are further exhibiting the property that they are sensitive to breakage upon occurrences of strokes and jolts.

Based on the method of magnetic induction it is possible to transfer energy through a suitable medium such as, for example, glass ceramics. This method is used in connection with modern inductive cooking fields, where a magnetic flux is generated in a suitable pot material through a glass-ceramic plate, where the magnetic flux directly heats the pot and where the heat is no longer transferred from the cooking field to the pot but, to the contrary, the heat is generated in the pot itself and only subsequently the residual heat is radiated back to the cooking field. This method achieves as a positive side effect, on the one hand, a clear reduction of the heat loss overall generated during the cooking process. However, on the other hand, much more important for the cooking itself is the fact that a change of the inducing flux has a spontaneous effect on the change of the fed-in energy just as occurs during the cooking with gas.

The magnetic flux is generated by a simple coil in connection with an inductive stove, wherein the coil is passed through by a high-frequency alternating current. The feed-in of energy can be controlled very finely metered and based on a suitable, commercially available electronic circuit.

Since in this context primarily the pot is heated, the time-dependent behavior of the change of the energy feed to the cooked materials is similarly direct as in the case of cooking with gas and, in general, even better.

An important step in connection with the development of modern kitchen technology was the introduction of kitchen workplates, which are today already employed as standard, which provide a homogeneous surface for the free operating continuously above the various bases such as cabinets, refrigerators, washing machines or dish washing machines and which are simple to clean based on the lack of interfering corners, edges, and open seams. In addition, an easily surveillable and flexibly organizable kitchen operation becomes possible.

In most recent times, stone, in particular granite, has proven to be an indestructible material for such workplaces. For example, one can cut with knives on the stone without leaving a scratch. The cleaning of granite is very simple based on the smooth and hard surface, since dirt and residues cannot really adhere even in case of an intensive use and a strong drying. Should this nevertheless happen, then these residues can be removed with hard objects without damaging the surface of the granite plate.

Such kitchen workplates are however still interrupted today by the cooking field, recessed in the plate, which still creates transitions in the region of the stove which are difficult to clean completely, and in particular prevents the user, based on the relatively sensitive surfaces of glass ceramics, from using the cooking field itself as a working field with the above recited advantages.

SUMMARY OF THE INVENTION

1. Purposes of the Invention

It is presented the task to integrate the cooking field as completely as possible into the workplate such that a homogeneous and easy-care surface is generated, wherein the surface is capable to connect the workplate regions to the right and to the left of the cooking field together with the cooking field proper to a continuous workplate based on the additional usability of the cooking field as a workplate.

An additional purpose is presented for the improvement of the wearability and the lifetime of cooking-field surfaces as well as a reduction of the surface temperature of induction cooking fields. Based on a decrease of the surface temperature, on the one hand, there are generated new possibilities of the use of temperature measurement equipment on the cooking field, which new possibilities of employing temperature measurement devices in turn represent new tasks for the temperature control of cooking processes on the cooking field, and which new possibilities of employing temperature measurement devices are already today employed in modern baking tubes and microwave ovens.

These and other objects and advantages of the present invention will become evident from the description which follows.

2. Brief Description of the Invention

This object is achieved by the combination of a stone plate (granite plate) having an intact surface and of one or several induction coils disposed underneath the stone, where the induction coils are placed at a sufficiently small distance relative to the surface in order to generate the magnetic flux density in the pot necessary for a transfer of the electric power. The pot in this case is simply placed onto the granite plate for cooking. This position can be marked on the plate with a suitable marking such as, for example, a limited number of small metallic distance spacers, which are entered into the granite surface and which provide a thermal insulation with the aid of the medium air. Removable distance spacers can also be employed as an alternative relative to the previous method. It is possible to dispense with such distance spacer if permitted by the thermal loadability of the respectively employed granite. In order to protect the granite in this context from the crack formation resulting from the effect of heat, which is typical for stone, the mechanical stabilization is provided by a suitable reinforcement. The slight heat generation on the cooking field surface, caused by the induction cooking field, allows for the employment of temperature measurement devices on the cooking field without danger, i.e. in the cooked material itself, and thus allows a program-controlled cooking based on computer-controlled heat feed or, respectively, automatically controlled heat feed.

A continuous workplate remains after the cooking and after the removal of the pots, wherein the continuous workplate is easy to clean based on its insensitivity to soiling and based on the seamless surface. In the following, the cooking field proper can be used as work field while benefiting from all the advantages of the stone material.

Damages of the surface from a burning in, scratching, and in particular jolts and strokes do not occur in contrast to the up to now employed glass-ceramic surfaces in connection with induction cooking fields based on the hardness of the granite.

One of the essential effects of the invention results in addition from the geometric form of the granite, surrounding the induction coil, in connection with the weakly ferromagnetic properties of granite materials, which thus effects a shielding of the spreading of electromagnetic waves.

Based on the geometry of the arrangement of the granite, in particular the thin granite web above the induction coil (about 7 mm) and the residual granite plate which is relatively thick relative to the thin granite web, where the residual granite plate surrounds the coil at the edge of the coil over a large surface, the magnetic field lines (H field) experience a substantially higher electromagnetic resistance at the edge of the coil than above the coil toward the pot material.

According to the Maxwell equations (in particular according to the fourth Maxwell equation div. B=0), according to which the magnetic field lines have to be closed, this effects a strong bundling of the H field in the center of the arrangement perpendicular to the thin granite web above the coil, and thus a substantial weakening of the relatively energy-rich stray fields, which occur in connection with conventional unshielded induction cooking fields, and where the stray fields cause the high energetic "electrosmog." Depending on the relation between the thickness of the web above the coil and the thickness of the remaining granite plate, the stray fields can be reduced in comparison to unshielded arrangements of induction coils to one tenth up to a hundredth, depending on the distance from the stove.

A further advantage is the better heat distribution, since the heat, in contrast to thin glass ceramic fields, in the stone with a typical thickness of 4 centimeters is conducted not only in a horizontal direction but also in a vertical direction, which as a consequence is associated with a reduction of the temperature at the surface. The reduction of the surface temperature can be further supported by the placing of the above-recited distance spacers. Thereby, the zones immediately around the pot remain hand warm.

These comparatively low temperatures on the cooking field allow the use of temperature measurement devices on the cooking field without damaging the heat lines required for the measurement by way of temperature sensors based on thermal overloading. This temperature measurement signal can be led to an automatic control circuit, which allows an automatic temperature surveillance or automatic temperature control by a computer. In case of using a freely programmable computer control, it becomes thereby possible to pass through cooking processes automatically and to store the temperature changes to be performed in suitable electronic media and, if desired, to reproduce these temperature changes to be performed in an identical way.

The thus generated kitchen workplate stove made of stone (stone stove) combines two essential advantages of the state of modern kitchen technology and generates a new third one:

1. the advantage of the immediate and direct energy transfer onto the material to be cooked material and thus the functionality of the fast heat-input change with the aid of the magnetic induction.
2. the advantage of the high loadability and ease of care of a continuous kitchen workplate of granite, which is not interrupted by the conventional transitions to the cooking field; and
3. the advantage of the employment of feed-back temperature measurement now, just as in baking ovens, on the cooking field, and thus to perform an automatic control of the cooking processes.
4. the advantage of the reduction of the stray fields which are common in connection with induction cooking fields.

The result is a stove which can be universally employed with additional functions with the novel feature of the complete integration into the kitchen workplate. The expenditure for care and keeping clean is reduced and additional work space is obtained while simultaneously increasing the lifetime of the surface.

The use of temperature measurement sensors with the very temperature-sensitive feed lines is now also possible on the cooking field without danger based on a temperature reduction, which allows the automatic controllability of cooking processes and thus furnishes a new dimension in the functionality of cooking fields.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
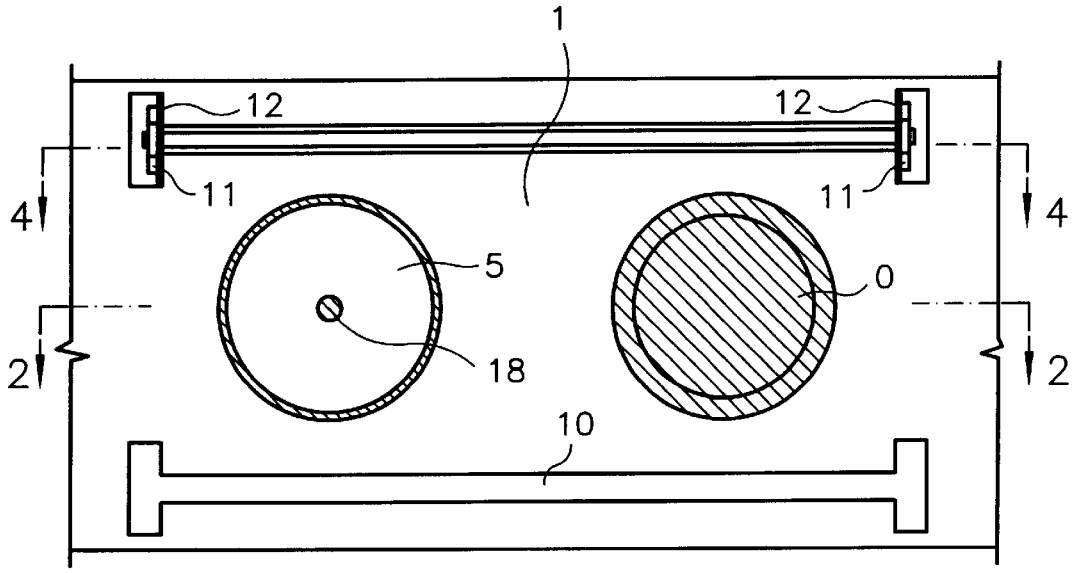
FIG. 1 is a schematic view of a workplate.

Milled cavities (o) are furnished in the stone plate (1) at the predetermined positions for performing the invention, where the diameters of the milled cavities are adapted to the diameter of the induction coils (2) to be employed. The remaining wall thickness of the workplate relative to the surface is selected such that, on the one hand, an energy transfer as high as possible onto the metal pot is present and, on the other hand, a sufficient mechanical stability of the stone is assured in the region of the milled cavity. In order still to assure this stability in the working material granite, the wall thickness should not be below a certain value (which is 7 mm in connection with most kinds of granite). In order to support a favorable pressure distribution and tensile stress distribution in the heated state of the stone, the milled cavities should have rounded edges in order to avoid a wedge effect. The rounding radius r of the chamfer is in this case dependent on the thickness of the granite plate employed and on the respective individual shape of the granite plate. The calculation of an optimum voltage distribution dependent on the rounding radius r of the chamfer and on the other geometric dimensions is performed with the aid of numerical computer simulation programs based on the method of finite elements (for example, the program package MARC). This calculation is under certain circumstances decisive for the respective individual construction of the invention while taking into consideration the mechanical stability of the workplate under heat impact.

Furthermore, it is required that the stone plate be mechanically stabilized in the region of the cooking field in order to avoid the formation of cracks based on thermal tension in the stone. Based on the mounting of armatures such as, for example, winding rods (6), the stone is mechanically pretensioned in order to compensate the thermal tensions in the granite plate occurring during operation. The winding rods are embedded into milled cavities (10) furnished for this purpose and the winding rods are pretensioned with nuts (11) and support washers (12).

A sandwich construction is an alternative to counteract the high mechanical load of the stone under heat impact and thus to avoid crack formation, where, as an armature, for example, a continuous carbon fiber plastic plate (17), about 3 mm strong, is glued between two granite plates of the same thickness. Carbon fiber compound materials are associated with the advantage that they exhibit similar expansion coefficients and the same expansion behavior as granite, however, they are associated with a high tensile strength in contrast to granite. Since the crack formation typically runs radially to the center of the cooking field, the direction of the carbon fiber course should therefore be, if possible, perpendicular to the radius of the cooking field and thus perpendicular to the possible course of a crack in order to compensate the expansion forces of the stone.

It is a cost question which method is preferred in the end for the stabilization of the stone and this depends on the individual geometry of the kitchen workplate. Carbon fiber laminates are at this time still materials which are processed at a relatively high cost.

The coil (2) itself is glued in place together with the thin mica plate (3) with a temperature-stable casting agent (9), for example, epoxy resin with carbon fiber content. The carbon fiber serves in this context for the mechanical stabilization of the thin stone web in the region of the milled cavity and the mica plate serves for the protection of the coil against overheating. In the following, a suitably adapted and cut inlet (5) of the same stone material as the working plate proper is inserted in the remaining hollow space for the mechanical end stabilization of the stone plate. All separating open seams are filled with the casting agent and the carbon fiber (9), which mechanically stabilizes after hardening has occurred and which protects the stone against breakage based on temperature tensions and stroke impact. Distance spacers (7) can be inserted optionally into the stone plate, in order, if necessary, to provide an additional thermal insulation based on an air gap between the stone plate and the pot.

The connections (4) of the induction coil as well as the possibly required further electrical lines for the connection of a temperature measurement sensor for preventing an excessive temperature in the stone, are led out either through the separating open seam between the workplate and the inlet or through a borehole 18 in the inlet, and are fed to a control electronics. For shielding the induction field in a downward direction, the coil is furnished on the bottom side with ferrite cores (8). The commercially available control apparatus of the induction coil is disposed independent of the location of the stove, and because of the heat generation, if possible, the control apparatus is disposed even remote from the stove, at a desired location in a space-saving way, and is automatically controlled by a commercially available personal computer (PC) employable as a board computer (15). The automatic control value is in this case the signal delivered by a temperature sensor (13) placed in the cooked material, where the signal is fed to the PC with the aid of a conventional analogue/digital converter (16). The operating field of the cooking stove with the automatic temperature controllers, furnished for the manual operation, is in turn installed independent of the location of the control electronics at a suitable location in the kitchen, preferably in the exhaust hood disposed above the cooking field. In order not to interfere with the usability of the stone surface as a work surface based on armatures, an optional child safety bow-shaped guard (14) is attached at the support washers (12) underneath the kitchen workplate, and where the child safety bow-shaped guard is removable and formed as shown in FIG. 3.

Figure 2:
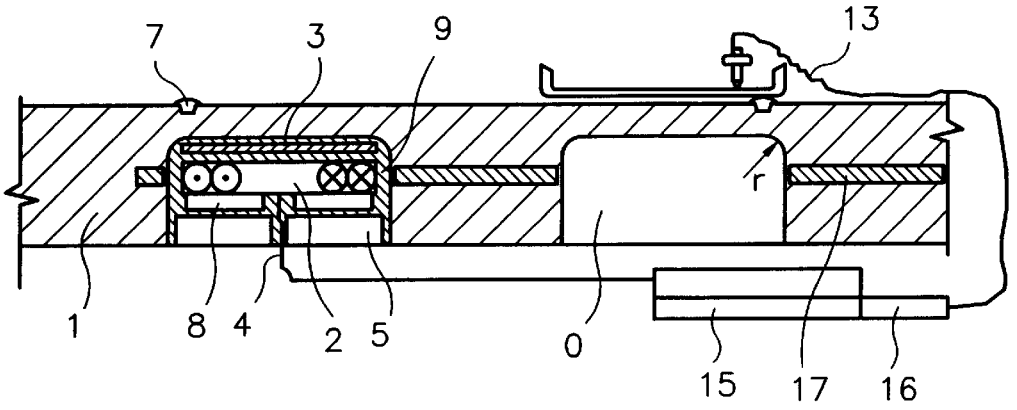
FIG. 2 is a sectional view of an optional reinforcement along line 2—2 shown in FIG. 1.

A preferred embodiment of the invention is illustrated schematically in FIGS. 1 and 2. There are shown the stone workplate 1 with milled cavity (0), the induction coil 2 with mica plate (3) and with electrical connections (4); the stabilizing stone inlet (5) and the metallic armatures (6), (11) and (12) embedded in the granite plate (1).

FIG. 2 shows also the optional reinforcement with a carbon fiber insert (17) as a dashed line.

Figure 3:
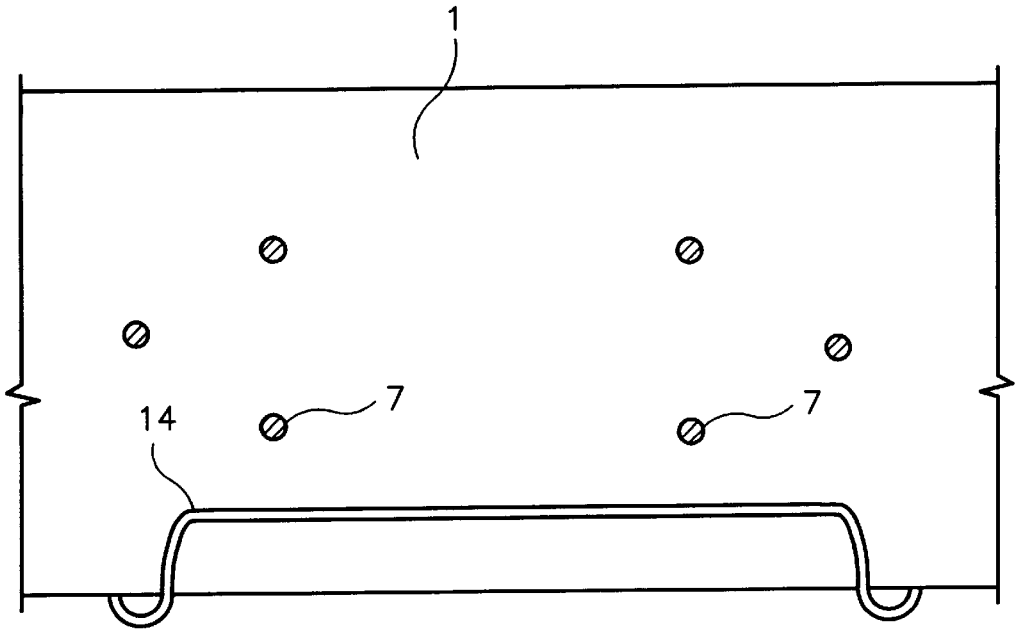
FIG. 3 is a schematic view of a granite plate.
Figure 4:
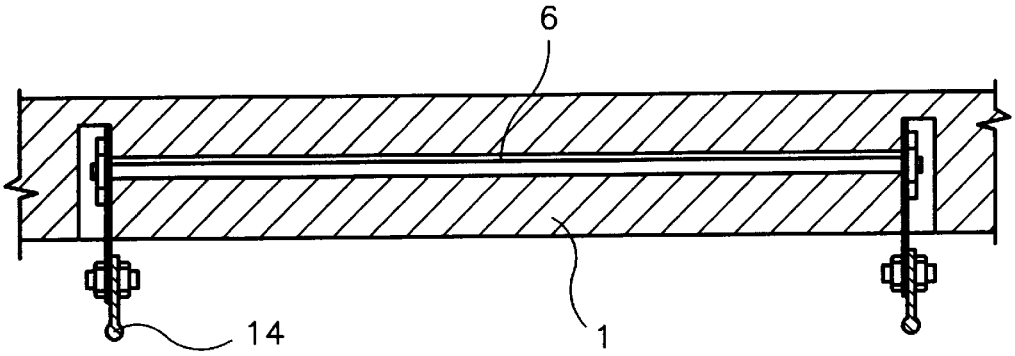
FIG. 4 is a sectional view of an inserted mechanical armatures along line 4—4 shown in FIG. 1.

FIG. 3 shows the granite plate with the distance spacers (7) and the child safety bow-shaped guard (14) from above. FIG. 4 shows the inserted mechanical armatures for stabilizing the stone in a sectional view from the side with the attachment of the child safety bow-shaped guard underneath the granite plate.

It will be understood that each of the elements described above, or two or more together, may also find a useful application in other types of kitchen workplate differing from the types described above.

While the invention has been illustrated and described as embodied in the context of a kitchen workplate with an integrated cooking field, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

We claim:

1. A kitchen workplace with integrated cooking field, which connects two elements known in kitchen technology, that is on the one hand an energy transfer by primary heating of a cooking pot by means of an electromagnetic induction principle and on the other hand using stone as an easy care and insensitive material for kitchen workplaces, wherein a stabilized workplace of stone mechanically stabilized by way of armatures is employed, wherein the workplace includes a recess milled out for an induction coil disposed below the plate as a cooking field, without being interrupted by usual crack-outs for inserting a cooking field, wherein the workplace which is to be integrated in the cooking field has a seamless transition, that is an uninterrupted transition into the cooking field proper thereby allowing an additional use of the cooking field as a full value part of the remaining workplate as long as cooking does not take place, and wherein a work area disposed right and left from the cooking field is seamlessly connected with the cooking field to a large uninterrupted and seamless work area.

2. The kitchen workplate according to claim 1, wherein a stone plate homogeneous surface employed as a stove top is limited to a size of the cooking field, wherein the size of the cooking field is determined individually by number and size of induction coils to be employed, and wherein the cooking field can alternatively also be used as a full value work field.

3. The kitchen workplate according to claim 2, wherein a removable bow as a child safety is applied under the stone plate, wherein the bow is attached under the workplate and not on the workplate in order to avoid interruption of homogeneity of the workplate and in order not to limit the function, and wherein the bow is removable by a simple hand action without that interfering attachments remain on the workplate.

4. The kitchen workplate according to claim 2, wherein temperature sensors are employed on the cooking field, which temperature sensors are entered into material to be prepared, wherein a measurement signal is sent by the temperature sensor to a control apparatus of the induction coil by a feed line over a cable, which measurement signal allows a time and temperature sensitive control of the heat which heat is controlled by a computer.

5. The kitchen workplate according to claim 4, wherein the computer assumes a control circuit between a temperature measurement at the temperature sensor in the material to be prepared and a temperature setting, wherein the computer is a commercially available personal computer, which feeds the measurement signal of the temperature sensor through analogue/digital converters and which automatically controls the control apparatus of the induction coil, wherein the computer is activated and operated by a switch and monitor integrated into an operating panel, wherein the computer is freely programmable with suitable electronic storage media and thus can read in cooking programs, which take care that a control electronics on the one hand is run through and that archived temperature courses in the cooking program are automatically repeated depending on time with the temperature measurement at the temperature sensor.

6. The kitchen workplate according to claim 4, wherein an operating panel for a manual operation of the control apparatus is applied independent of where the cooking field and the casing of the control electronics are located, wherein the operating panel operates the computer and carries a liquid crystal display as a monitor used for the computer, and wherein the computer takes care freely programmable for the automatic control.

7. The kitchen workplate according to claim 6, wherein manual functions of the cooking field are controllable by infrared remote control and wherein a child safety is securable with said remote control.

8. The kitchen workplate according to claim 1, wherein weakly ferromagnetic properties of granite in connection with an electromagnetic resistance difference between a thin stone web between pot and coil and a thicker edge zone relative to the remaining workplate there is generated and effected a shielding of an edge zone of a magnetic field toward the pot material and thus a special geometry of the stone material surrounding the induction coil effects a reduction of magnetic stray fields.

9. A kitchen workplate with an integrated cooking field, comprising a stone workplate having a continuous surface and an underside;

a first cavity structure milled out at a predetermined position in the underside of the stone workplate;

an induction coil placed into the first cavity structure, wherein the first cavity structure and the induction coil form a cooking field;

a reinforcement providing a mechanical stabilization in the region of the cooking field in order to prevent crack formation in the stone workplate resulting from thermal effects;

a plurality of metallic distance spacers entered into and disposed on the surface of the stone workplate and marking a place for placing cooking utensils into the cooking field and providing a thermal insulation employing air as a medium of insulation;

wherein the cooking field and the remaining stone workplate show a seamless continuous stone workplate with an uninterrupted transition to the cooking field from the top.

10. The kitchen workplate with an integrated cooking field according to claim 9, wherein the metallic distance spacers are removable from the surface of the stone workplate.

11. The kitchen workplate with an integrated cooking field according to claim 9, wherein the stone is a granite stone.

12. The kitchen workplate with an integrated cooking field according to claim 9, further comprising a second cavity milled out at a predetermined position in the underside of the stone workplate;

a winding rod embedded into said second cavity;

a nut;

a support washer, wherein the nut and the support washer are disposed at the winding rod for pretensioning the winding rod, and wherein the winding rod embedded in the second cavity forms the reinforcement of the cooking field.

13. The kitchen workplate with an integrated cooking field according to claim 9, wherein the diameter of the first cavity structure matches the diameter of the induction coil;

wherein a thickness of the workplate at the first cavity structure is at least 7 mm;

wherein the first cavity structure has a rounded edge, wherein the first cavity structure is furnished with a chamfer, and wherein a rounding radius of the chamfer is dependent on the thickness of the workplate.

14. The kitchen workplate with an integrated cooking field according to claim 9, further comprising a mica plate, wherein the induction coil is glued together with the mica plate into the first cavity with a temperature-resistant casting agent, and wherein the mica plate serves for protecting the induction coil against overheating;

an inlet plate made of a like material as a material of the workplate and including an inlet bore and inserted over the induction coil into the first cavity, wherein the inlet plate has such a thickness as to fill a remaining hollow space in the first cavity, and wherein open seams between a wall of the first cavity and the induction coil, and the induction coil and the inlet plate are filled with the casting agent and a carbon fiber;

wherein the first cavity has such a depth as to accommodate thicknesses of the induction coil and the inlet plate;

a current connection line connected to the induction coil;

additional required electric lines passing through the inlet bore of the inlet plate and fed to a control electronics;

a ferrite core disposed underneath the induction coil to shield an induction field in downward direction.

15. The kitchen workplate with an integrated cooking field according to claim 9, wherein the workplate is formed of two superposed stone plates having the same thickness, and wherein the reinforcement of the workplate is provided by a continuous carbon fiber plastic plate having a thickness of about 3 mm and glued inbetween the two superposed stone plates.

16. The kitchen workplate with an integrated cooking field according to claim 9, wherein the size of the cooking field is determined by the number and size of the induction coils installed in the workplate, and wherein the cooking field alternately serves as a work surface.

17. The kitchen workplate with an integrated cooking field according to claim 9, further comprising a removable child-safety bow-shaped guard attached to support washers underneath the workplate and extending over the width of the cooking field.

18. The kitchen workplate with an integrated cooking field according to claim 9, further comprising a control apparatus of the induction coil disposed remote relative to the cooking field;

a personal computer connected to the control apparatus and employable as a board computer for automatically controlling the control apparatus;

a temperature sensor to be inserted into the material to be prepared;

an analogue digital arrester connected to the personal computer and to the temperature sensor, wherein the temperature sensor sends a temperature measurement value by means of a measurement signal to the personal computer by means of the analogue/digital converter, wherein the measurement signal allows a time-sensitive and temperature-sensitive control of heat supplied to the cooking field and controlled by the personal computer.

19. The kitchen workplate with an integrated cooking field according to claim 18, wherein the personal computer assumes control between the temperature measurement value in the material to be prepared and a preset temperature setting.

20. The kitchen workplate with an integrated cooking field according to claim 18, further comprising an operating panel attached to the control apparatus, wherein the personal computer is activated and operated through a switch and a monitor integrated into the operating panel.

21. The kitchen workplate with an integrated cooking field according to claim 18, further comprising electronic memory storage connected to the personal computer, wherein the personal computer is programmable based on an entering of cooking programs into the electronic memory storage, wherein said cooking programs induce that the control electronics on the one hand is activated, and wherein archived temperature courses in the cooking programs are automatically repeated depending on the time based on temperature measurement values delivered by the measurement signal.

22. The kitchen workplate with an integrated cooking field according to claim 20, wherein the operating panel for a manual operation of the control apparatus is placed independent of the location of the cooking field and of the casing of the control electronics, wherein functions of the personal computer are in addition operable from the operating panel, and wherein the operating panel carries a liquid crystal display as a monitor used for the personal computer, and wherein the personal computer furnishes a freely programmable automatic control.

23. The kitchen workplate with an integrated cooking field according to claim 22, further comprising an infrared remote control connected to the control apparatus, wherein the manual operation of the cooking field is controlled by the infrared remote control;

a removable child-safety bow-shaped guard, attached through support washers underneath the workplate, and securable with said remote control.

24. The kitchen workplate with an integrated cooking field according to claim 9, wherein the stone workplate is made of granite, wherein the granite exhibits weakly ferromagnetic properties, wherein an electromagnetic resistance difference exists between a thin stone web between the cooking pot and the induction coil and a thicker edge zone relative to the remaining workplate, wherein a shielding of the edge zone and a bundling of a magnetic field toward the cooking utensil is generated and effected, and wherein the geometry of the stone material surrounding the induction coil effects a shielding of magnetic stray fields.

25. The kitchen workplate with an integrated cooking field according to claim 9, wherein the stone workplate has a flat continuous upper surface; wherein the thickness of the stone is from about 7 millimeters to 4 centimeters.

26. The kitchen workplate with an integrated cooking field according to claim 9, further comprising a second cavity structure milled out of at a predetermined second position on the underside of the stone workplate, wherein a distance between the first cavity structure and the second cavity structure is smaller than the diameter of the first cavity structure.

27. The kitchen workplate with an integrated cooking field according to claim 17, wherein the bow-shaped guard extends along the front of and on top of the workplate;

wherein an elongated channel having a first expanding end and a second expanding end is milled out on the underside of the workplate;

wherein a tie rod is placed in the elongated channel;

wherein the tie rod is fastened with a first end in the first expanding end by way of a first nut and wherein the tie rod is fastened with a second end in the second expanding end by way of a second nut;

wherein a first end of the bow-shaped guard is attached to the first end of the tie rod and wherein a second end of the bow-shaped guard is attached to the second end of the tie rod.

* * * * *